United States Patent [19]

DeWitt et al.

[11] Patent Number: 4,605,216

[45] Date of Patent: Aug. 12, 1986

[54] MATERIAL PICK-UP MECHANISM

[75] Inventors: Albert C. DeWitt, Warren; Donald W. Herriges, Mt. Clemens; Donald Stanner, Milford, all of Mich.

[73] Assignee: General Motors Corporation, Detroit, Mich.

[21] Appl. No.: 633,930

[22] Filed: Jul. 24, 1984

[51] Int. Cl.[4] ..... B65H 3/22

[52] U.S. Cl. ..... 271/18.3; 271/10; 271/19

[58] Field of Search ..... 271/42, 16, 18.3, 19, 271/18, 21, 22, 23, 119, 120, 141, 142, 168, 206, 204, 209; 221/213, 215

[56] References Cited

U.S. PATENT DOCUMENTS

| | | | |
|---|---|---|---|
| 793,009 | 6/1905 | Miller | 271/18.3 |
| 3,064,968 | 11/1962 | Starnes | 271/16 X |
| 3,176,979 | 4/1965 | Engelmann | 271/18.3 |
| 3,276,770 | 10/1966 | Griswold | 271/19 |
| 3,285,649 | 11/1966 | Harton | 221/213 |
| 3,625,506 | 12/1971 | Rovin | 271/18.3 |
| 3,813,094 | 5/1974 | Walton et al. | 271/18.3 X |
| 3,856,294 | 12/1974 | Lutts et al. | 271/19 X |
| 3,877,695 | 4/1975 | Carroll | 271/18 |
| 3,902,750 | 9/1975 | Roitel | 271/18.3 X |
| 4,008,888 | 2/1977 | Vinciguerra | 271/18.3 |
| 4,009,786 | 3/1977 | Littlewood | 271/18.3 |
| 4,346,877 | 8/1982 | Doyen et al. | 271/19 |
| 4,372,548 | 2/1983 | Anrich et al. | 271/18.3 |
| 4,505,468 | 3/1985 | Heisler | 271/18.3 |

FOREIGN PATENT DOCUMENTS 0219160 2/1985 Fed. Rep. of Germany ..... 271/18.3

OTHER PUBLICATIONS

Murray, J. M., "Single-Ply Pick-Up Devices," AAMA Apparel Research Journal, Dec. 1975, p. 87.

Advertisement-Gepec Cloth Pickup*, Gepec Machinery, 7 Cochrane Place, Victoria, Australia 3053 (1975).

*Primary Examiner*—Bruce H. Stoner, Jr.

*Assistant Examiner*—Lawrence J. Goffney, Jr.

*Attorney, Agent, or Firm*—Patrick M. Griffin

[57] ABSTRACT

An improved material pick-up device to allow sheets of material of varying texture and resiliency to be picked up and moved without piercing and without damage thereto. A pair of support members having saw-tooth shaped projections thereon are guided and supported to be relatively reciprocated along side by side paths to move the projections together and apart. The reciprocation is carefully controlled and adjusted by an adjusting device cooperably with the device powering the reciprocation so that the spacing of the respective pairs of teeth in the support members may be carefully controlled to define a gripping position and a release position. Thus, the gripping position may be varied in accordance with the texture and resiliency of the material to be gripped such that the surface of the material is pinched without piercing and can be moved without damage thereto. In one embodiment, a pair of coaxial cylindrical supports are nested together and one rotates relative to the other. In another embodiment, a pair of linear blades having saw-tooth projections thereon are held for side by side reciprocation.

3 Claims, 11 Drawing Figures

MATERIAL PICK-UP MECHANISM

This invention relates to a material pick-up device and specifically to an improved mechanism for picking up and releasing materials of varying texture and resiliency without piercing the materials.

BACKGROUND OF THE INVENTION

It is often necessary to move individual pieces of a stack of materials, such as sheets of cloth or fiberboard, from one position to another, one at a time, for work to be performed thereon. Mechanisms to perform this operation generally do so by providing a gripper foot which pierces and penetrates the surface of the top sheet of material in order to hold, lift and move it. This clearly has potential for damaging material.

An example of this type of pick-up mechanism may be seen in Engelmann U.S. Pat. No. 3,176,979. As may be thereseen in FIG. 1, oppositely directed, angled rows of piercing needles 10 and 11 are supported so as to slidably reciprocate parallel to each other. When the needles engage a sheet of material, they are moved in opposite directions so as to pierce and stretch the sheet of material to hold it. To release the material, the rows of needles are moved back apart, thus exiting the material and dropping it. Such a mechanism has, of course, the potential for piercing more than one sheet of material if the needles are longer than the material is thick.

Another type of pick-up device may be seen in the Rovin U.S. Pat. No. 3,625,506. Rovin is a variation of the design of Engelmann which seeks to differentiate the top sheet of a stack of sheets before it is pierced. As may be seen in FIG. 13 thereof, stop surfaces 64 on gripper feet 62 mound up a patch 66*a* of sheet 66 prior to pointed feet 57 piercing the material. It would be desirable to provide a gripper mechanism which would not pierce the material, thus avoiding the possibility of damage thereto, while still differentiating and securely holding and differentiating the top sheet of a stack.

SUMMARY OF THE INVENTION

The subject invention provides an improved pick-up mechanism which will differentiate, grip and release the top sheet of a stack of materials as it is moved between a pick-up position and a remote position. This is done without piercing or damaging the surface of the material. In addition, the device may be adjusted to accommodate different materials of varying textures and resiliency.

The first embodiment of the invention includes a pair of coaxial cylindrical support members, one of which is closely contained within and rotatable within the other. Each support member has a series of evenly spaced saw-toothed shaped projections, the points of which constitute gripping surfaces which may be disposed all in substantially the same plane. The points of the projections on each support member may each be radially aligned with the point of a respective projection on the other support member, so that the pairs of respective gripping surfaces provided thereby are always spaced apart by substantially the same amount.

The support members are in turn supported by means to guide the support members to be rotatably reciprocated, one within the other, along circular, side by side paths. The point of each projection will, therefore, move together and apart within the same plane relative to its respective projection point on the other support member. A power source is provided to so reciprocate the support members and to move the respective gripping surfaces together as the mechanism is moved to pick-up position and apart when the mechanism is moved to the remote position. In the embodiment disclosed, the power means is an air cylinder.

In addition, an adjustment means cooperates between the power means and the guiding means to control the reciprocation to adjustably limit the distance that the respective gripping surfaces move together and apart, to define, respectively, gripping and release positions thereof. In the first embodiment disclosed, this adjusting means is a cam engaged by adjustable stops. The separation of the respective gripping surfaces at gripping position is made just sufficient to pinch the top surface of the sheet of material without piercing it. At release position they are moved far enough apart to drop and release the material. The gripping and release positions of the gripping surfaces are made to coincide, respectively, with the pick-up position and the remote position of the pick-up mechanism itself. This is done by any suitable control mechanism.

In a second embodiment, the operation is similar, but the support members are a pair of straight, parallel blades with identically spaced projections, the points of which provide gripping surfaces. A frame supports the blades for side by side reciprocation. An air cylinder acts as the power means. A pair of adjustable stops on the frame are engaged by another stop member on the air cylinder to define the gripping and release positions of the respective gripping surfaces It is, therefore, an object of the invention to provide an improved material pick-up mechanism which will differentiate and securely pick-up and hold the top sheet of a stack of material sheets without damaging it.

It is a further object of the invention to provide such an improved pick-up mechanism in which at least two support members having projections with gripping surfaces thereon are guidingly reciprocated to grip and hold a sheet of material without piercing it.

It is yet another object of the invention to provide such an improved pick-up mechanism in which the gripping and release positions of the respective gripping surfaces of the projections of the support members may be adjustably controlled in accord with varying material texture and resiliency so that different materials may be handled without damage and without piercing the surface thereof.

BRIEF DESCRIPTION OF THE DRAWINGS

These and other objects of the invention will appear from the following description and drawings in which.

DESCRIPTION OF THE PREFERRED EMBODIMENT

Figure 1:
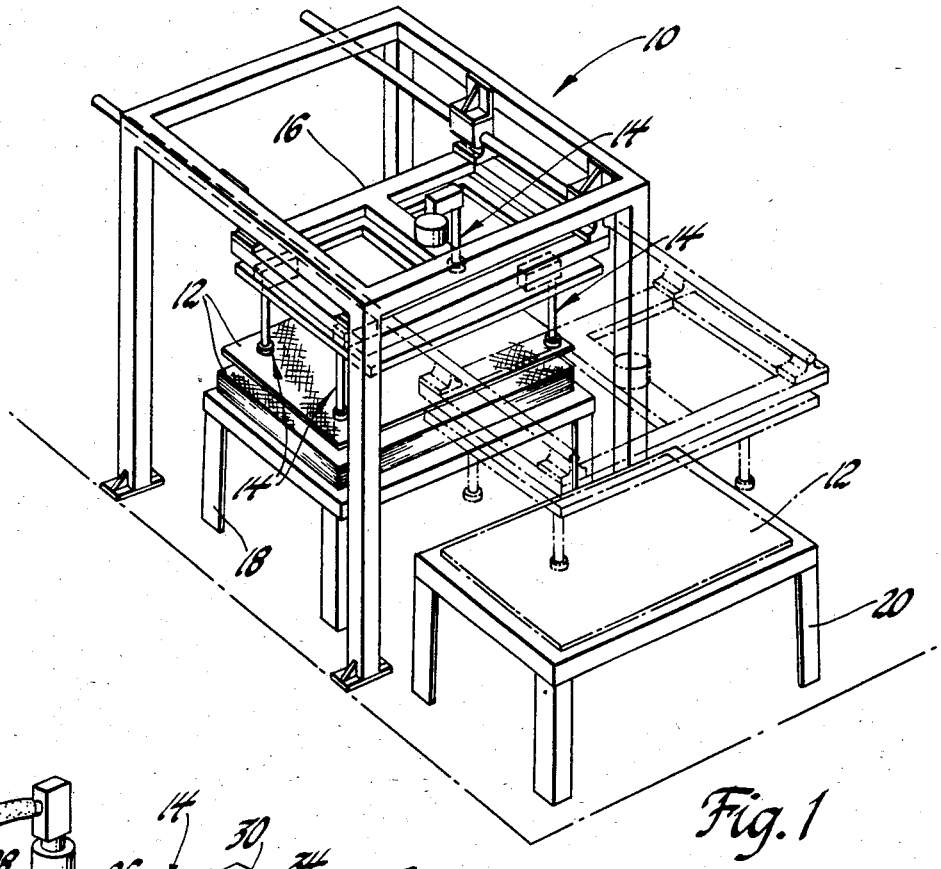
FIG. 1 is a perspective view of a press or other machine incorporating four of the material pick-up mechanisms of the invention.

Referring first to FIG. 1, a press or other machine 10 for handling and performing some work operation on a stack of sheets of material 12 includes four of the improved material pick-up mechanisms of the invention, designated generally at 14. Press 10 has a main frame 16 which, through some conventional control and power means not shown, moves the pick-up mechanisms 14 to a pick-up position shown in solid lines. There, the pick-up mechanism 14 will move against a sheet of material 12 which will be gripped and lifted from a storage station 18. From there, the material 12 is moved to a remote position in dotted lines where it will be released at a work station 20 to have some operation performed thereto. Any mechanical material pick-up mechanism will, of course, be moved in essentially this fashion The details of the press 10 and the operations performed thereby are not specifically relevant to the operation of the invention and are not further described.

Figure 2:
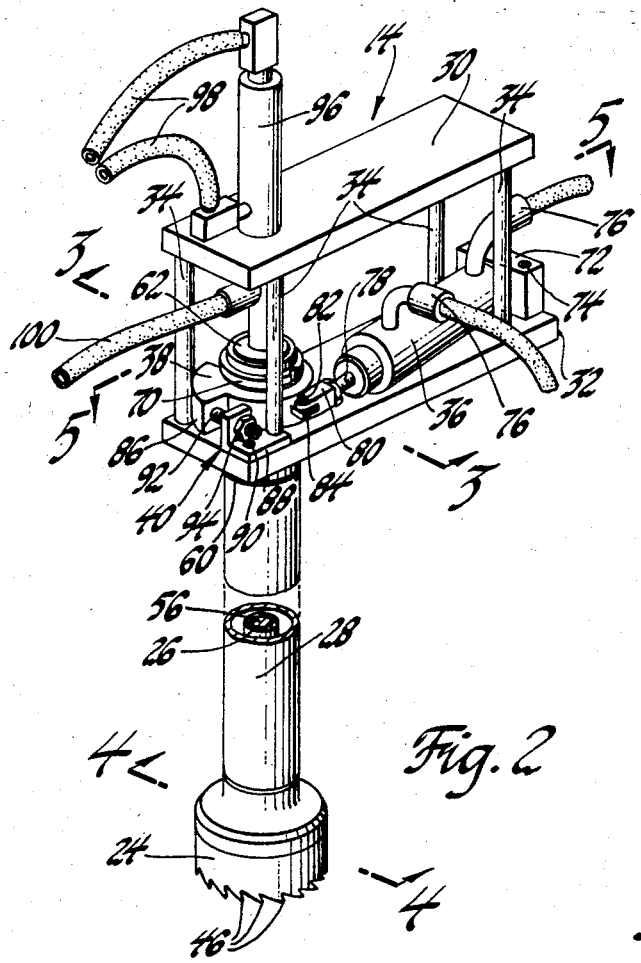
FIG. 2 is an enlarged view of one of the material pick-up mechanisms of the invention showing a first embodiment thereof.
Figure 4:
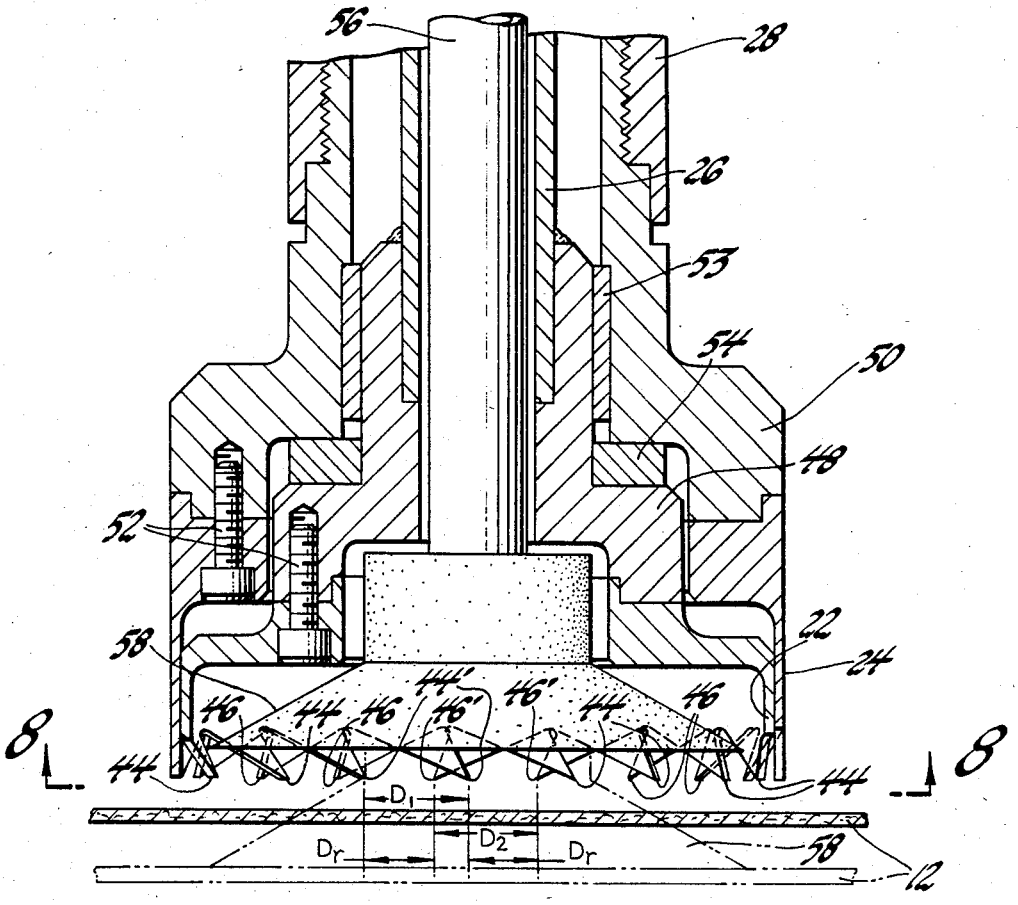
FIG. 4 is a cross sectional view taken along the line 4—4 of FIG. 2 showing the release position.

Referring next to FIGS. 2 and 4, the improved material pick-up mechanism 14 includes, in a first embodiment, a pair of coaxial cylindrical support members 22 and 24. These are, in turn, guided by and supported by means including coaxial inner and outer shafts 26 and 28. Shafts 26 and 28 are in turn supported on a subframe including upper and lower plates 30 and 32 spaced apart by struts 34. A power means consisting generally of an air cylinder 36 serves to relatively rotate shafts 26 and 28, and to in turn relatively reciprocate cylindrical supports 22 and 24. This reciprocation is controlled in cooperation with an adjusting means consisting generally of cam 38 and adjusting stops designated generally at 40 and 42, see FIG. 5. Details of the support members, guide means, power means and adjusting means will be described in order below.

Figure 9:
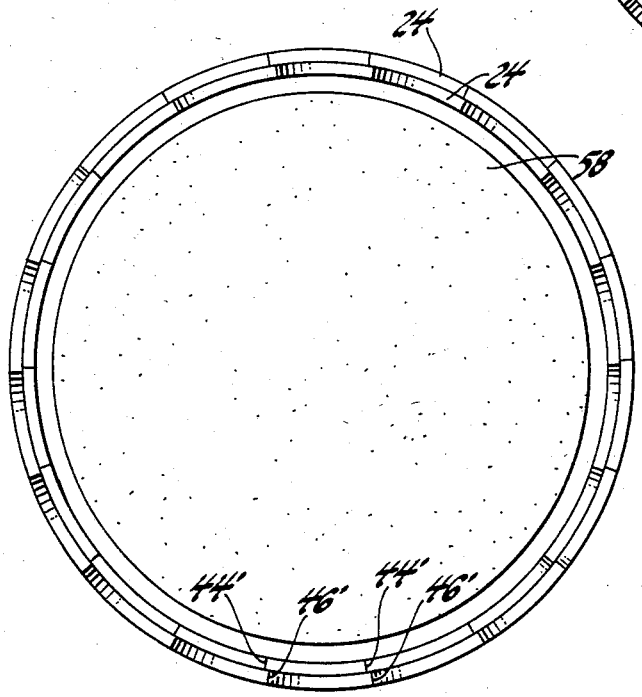

Referring next to FIG. 4, inner and outer cylindrical support members 22 and 24 are closely received or nested coaxially, one within the other. Each includes a series of saw-tooth shaped, oppositely directed projections 44 and 46, respectively, the points of which constitute gripper surfaces. Two pairs of each, 44′ and 46′, are distinguished for ease of description, and only these are denoted in following figures. The point of each projection 44′ is spaced a distance $D_1$ from the point of each adjacent projection 44′. The point of each projection 46′ is spaced a distance $D_2$ from the point of each adjacent projection 46′. As may be seen by referring to FIG. 9, each projection 44′ is radially alignable with a respective projection 46′ making the spacings $D_1$ and $D_2$ substantially identical. FIG. 9 shows the respective points of projections 44′–46′ very nearly radially aligned. The purpose for this will be further described below. However, it will be understood that the points of the pairs of respective projections 44′–46′ will be spaced apart substantially identically. That spacing in FIG. 4 is denoted $D_r$ and is defined below. Still referring to FIG. 4, it may be also seen that the points of all the projections 44 and 46 are disposable in a plane.

The means guiding support members 22 and 24 for rotatable reciprocation are next described. Still referring to FIG. 4, inner support member 22 is joined to an inner collar 48 and outer support member 24 is joined to an outer collar 50 coaxial therewith by screws 52, which allows them to be removed if desired. Inner collar 48 is welded to the lower end of inner shaft 26 and outer collar 50 is threaded to the lower end of outer shaft 28. A plain bearing 53 is located radially between inner and outer collars 48 and 50, and a thrust bearing 54 is located axially therebetween. A central shaft 56 rests within inner support member 22, with a vacuum cup 58 at the lower end thereof. This provides an additional feature described below.

Figure 3:
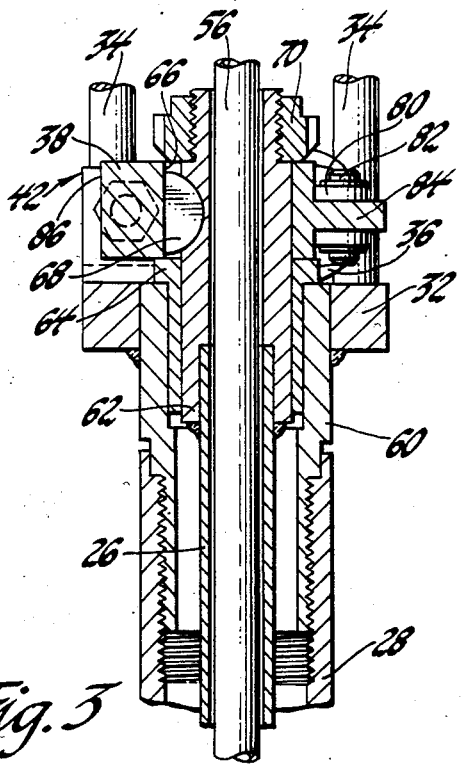
FIG. 3 is an enlarged cross sectional view taken along the line 3—3 of FIG. 2.

Referring next to FIGS. 2 and 3, the upper end of outer shaft 28 is threaded to an outer sleeve 60 which is, in turn, welded to and passes through lower plate 32. The upper end of inner shaft 26 is welded to inner sleeve 62 which passes coaxially out through outer sleeve 60. Inner sleeve 62 is rotatably supported within outer sleeve 60 by flanged bearing 64. Inner sleeve 62 passes through an aperture 66 in cam 38 to which it is nonrotatably held by a woodruff key 68. The upper end of inner sleeve 62 is threaded and receives nut 70 which bears against the top of cam 38. Tightening nut 70 serves to pull inner shaft 26 up tightly within outer shaft 28 to pull the top of inner collar 48 against thrust bearing 54. Thus, inner shaft 26 is completely rotatably supported within outer shaft 28, as is support member 22 within 24. In addition, by machining the thickness of thrust bearing 54, it may be assured that the points of projections 44 and 46 all lie in the same plane after nut 70 is tightened.

Figure 5:
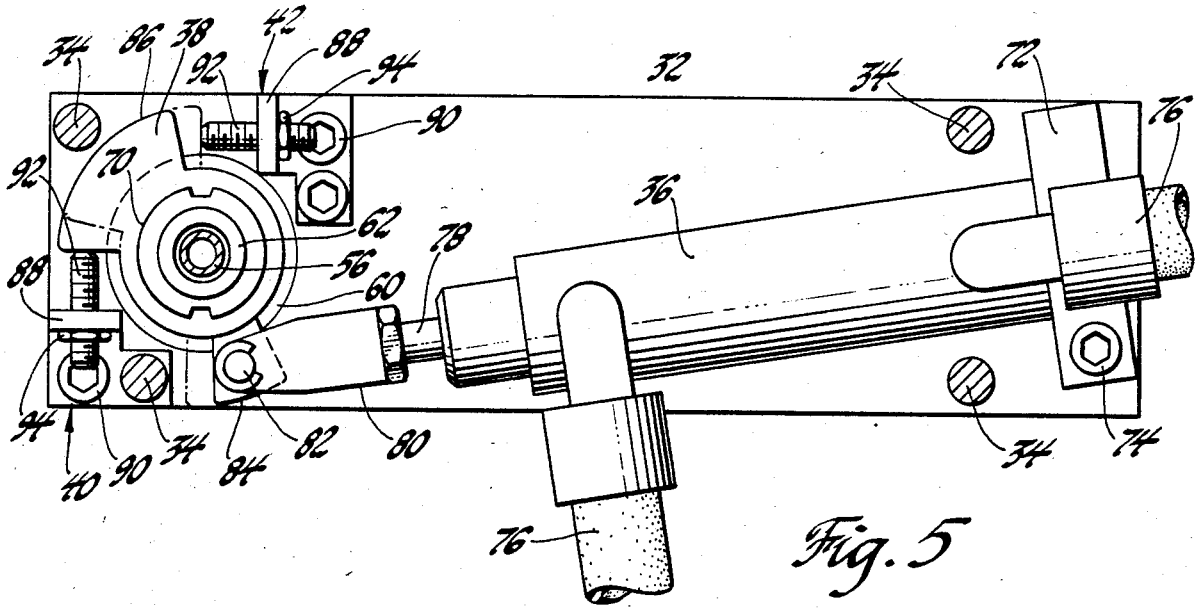
FIG. 5 is a plan view taken along the line 5—5 of FIG. 2.

The power means for rotatably reciprocating inner support 22 within outer support 24 may be seen by referring to FIGS. 5 and 2. The base of air cylinder 36 is joined to a base block 72 which is in turn pivoted at pin 74 to lower plate 32. Conventional hose fittings 76 feed the air cylinder 36 Shaft 78 is joined by yoke 80 and pin 82 to a projecting ear 84 on one side of cam 38. As shaft 78 extends and retracts, air cylinder 36 pivots on pin 74 and cam 38 is rotated back and forth. This rotates the inner sleeve 62 to which cam 38 is keyed, rotating inner shaft 26, and ultimately rotating and reciprocating inner support 22 within outer support 24.

This powered reciprocation is adjustably controlled by a generally wedge shaped stop block 86 on cam 38 in cooperation with the adjusting stops 40 and 42. Each adjusting stop 40 and 42 consists of a bracket 88 bolted at 90 to lower plate 32 with a threaded shaft 92 and nut 94 passing therethrough. The sides of stop block 86 engage the adjusting stops 40 and 42 as shaft 78 extends and retracts. By threading shafts 92 in or out the relative motions of the respective gripping surfaces are precisely controlled, as is next described.

Figure 8:
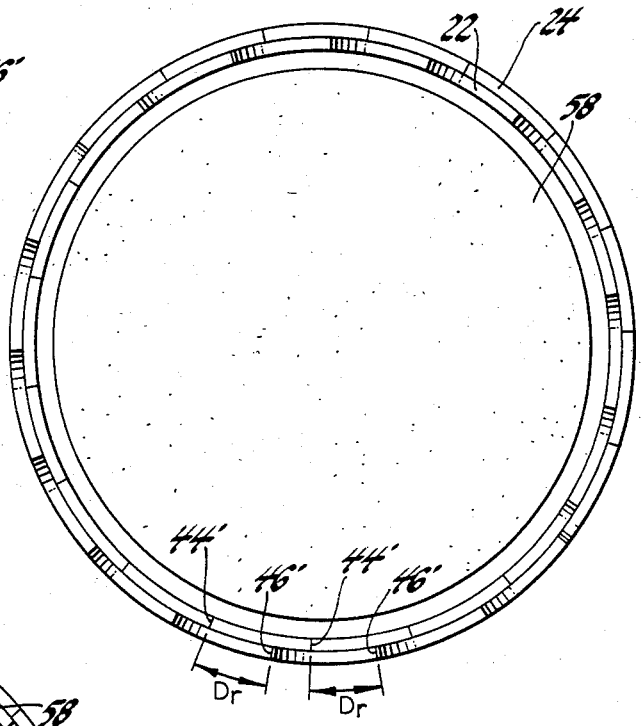
FIGS. 8 and 9 are views taken along the lines 8—8 and 9—9 of FIGS. 4 and 6, respectively, but showing the support members unsectioned.

Referring again to FIG. 4, the position of the respective gripping surfaces shown may be called the release position. The points of the two pairs of respective projections 44′ and 46′ are separated by a distance designated as $D_r$, which is less than either $D_1$ or $D_2$. $D_r$ is controlled and defined by the engagement of one side of stop block 86 with shaft 92 of adjusting stop 40, as seen in FIG. 5 in solid lines. This engagement occurs when shaft 78 retracts. Turning shaft 92 back would increase the counterclockwise rotation of cam 38 and increase $D_r$. FIG. 8 is a view from beneath support members 22 and 24 showing the release position separation of the points of projections 44′ and 46′. Some separate control mechanism, not shown, is used to retract shaft 78 to match this release position with the remote position of pick-up mechanism 14. The factors involved in setting $D_r$ will be described below.

Figure 6:
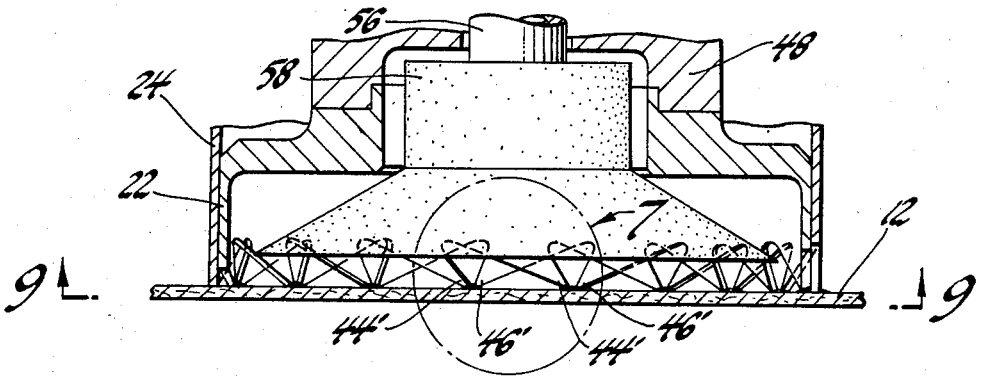
FIG. 6 is a view similar to FIG. 4 with the gripping surfaces gripping a sheet of material.
Figure 7:
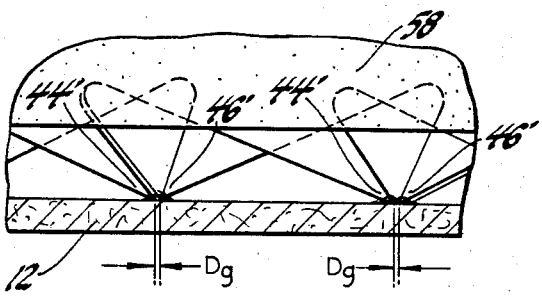
FIG. 7 is an enlargement of a portion of FIG. 6.

Referring next to FIGS. 6 and 9, pick up mechanism 14 has been moved into its pick-up position with the points of projections 44' and 46' engaged with the top surface of sheet 12. Simultaneously, the control mechanism referred to above has extended shaft 78 and rotated cam 38 clockwise to engage the other side of stop block 86, shown in dotted lines in FIG. 5, with the other adjusting stop 42. This has served to move the points of projections 44' toward the points of projections 46' to a position where they are nearly touching, which may be referred to as the gripping position. As seen in FIG. 9, projections 44' and 46' are nearly radially aligned with one another. The gripping position separation $D_g$ is shown in FIG. 7 and is very slight. The separation may, of course, be precisely adjusted with the other adjusting stop 42. $D_g$ is chosen in accord with the texture and resiliency of material 12, so that, as seen in FIG. 7, just a few fibers of the top surface of material 12 will be mounded up and pinched, without piercing, substantially without puckering the material 12, and without significant damage. The sheet of mat 12 may then be lifted up and moved to a remote position and released, as seen in FIG. 1. The separation $D_r$ needs merely to be sufficiently great that the fibers of material 12 will be released when projections 44' move back away from projections 46', and this will again vary with the resiliency and texture of the material. It is a simple matter to set stops 40 and 42 in accord with each type of material until the desired gripping and releasing is achieved.

As an additional feature, as seen in FIG. 2, a conventional vacuum actuator 96 fed by conventional hoses 98 serves to move central shaft 56 and vacuum cup axially out to the dotted line position seen in FIG. 4. This will help strip materials 12 which may not release as easily. Additionally, a vacuum source 100 allows vacuum cup 58 to separately pick up and release nonporous, heavy materials, independently. This increases the versatility of the system.

Figure 10:
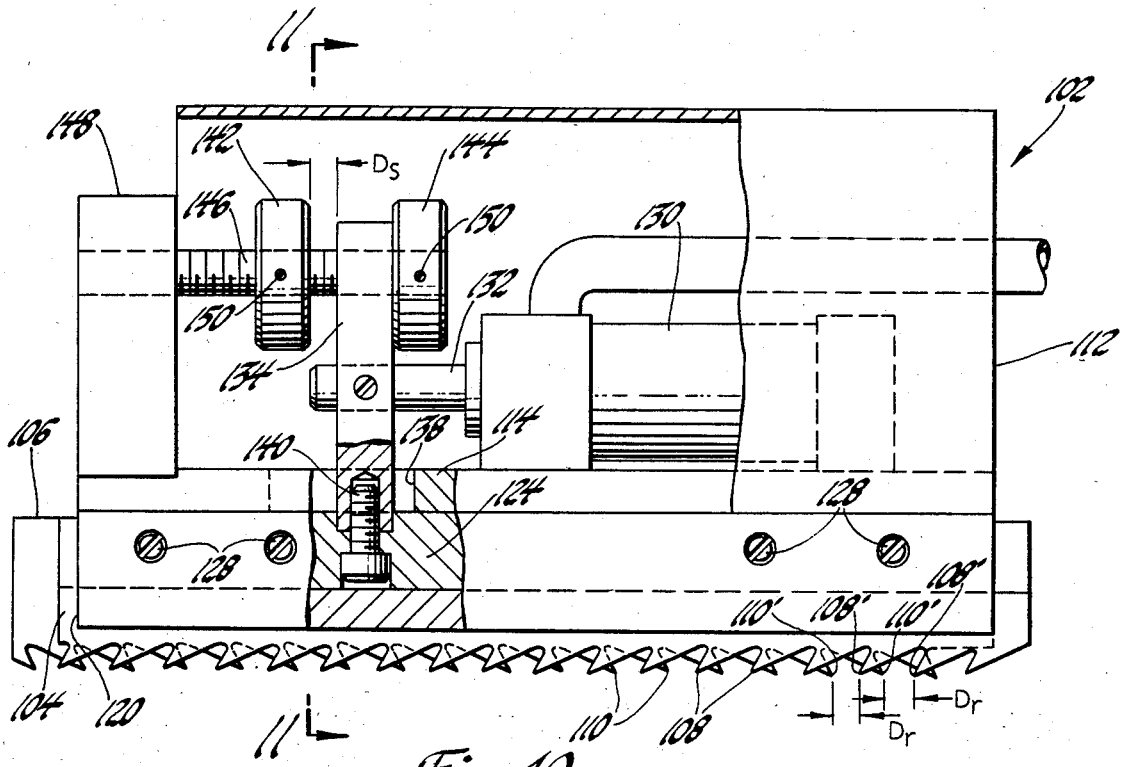
FIG. 10 shows a second embodiment of the invention in the release position.
Figure 11:
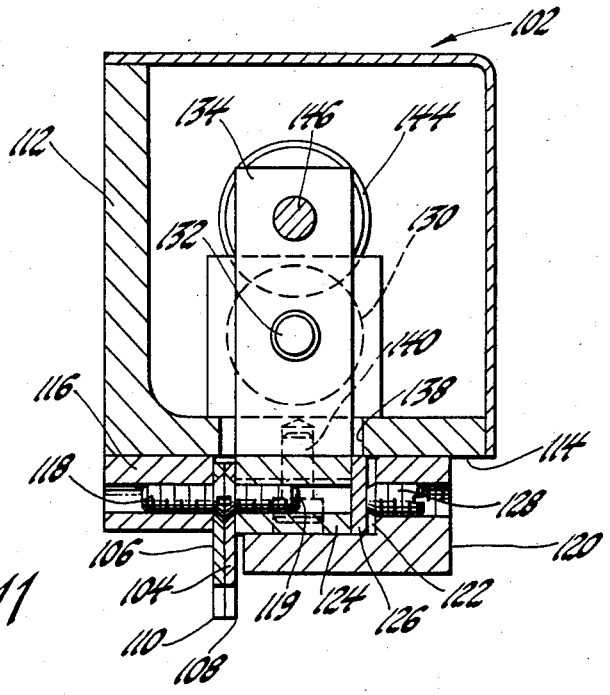
FIG. 11 is a view taken along line 11—11 of FIG. 10.

A second embodiment of the improved pick-up mechanism may be seen in FIGS. 10 and 11 designated generally at 102. In this embodiment, the support members are linear, side by side blades 104 and 106. Each blade 104 and 106 has a series of oppositely directed saw-tooth shaped projections 108 and 110, respectively, shaped similarly to those of the first embodiment. Two pairs of respective projections 108' and 110' are distinguished. In the second embodiment, since support members 104 and 106 are straight, the spacing between adjacent projections is made as nearly identical as machining tolerances will allow. This, of course, assures that the spacing between the points of the pairs of respective projections 108' and 110' is always nearly identical. This spacing is designated $D_r$, as FIG. 10 shows the release position.

Referring to FIG. 11, a generally box shaped frame 112 has a ground flat base 114 with a generally rectangular mounting portion 116 separately attached thereto by means not shown. Blade 106 is attached to mounting portion 116 by flush, flat head screws 118. A rail 120 having a generally L-shaped cross section is separately attached by means not shown to the base 114, parallel to mounting portion 116. Rail 120 forms a generally rectangular slideway 122 with base 114. A generally rectangular slide 124 has a thickness that fits closely within slideway 122, but with a smaller width. The other blade 104 is mounted to one side of slide 124, also with flush flat head screws 119. Slide 124 is received in slideway 122 with blades 104 and 106 slidably engaged with one another. It will be understood that the blades 104 and 106 are mounted identically spaced from the base 114 so that the gripping surfaces provided by the points of their projections 108 and 110 will lie in a plane. The other side of slide 124 is engaged by a separate bearing plate 126 which is held steadily in place by set screws 128 received through rail 120. The mounting portion 116, rail 120, slide 124 as well as the engagement of blades 104 and 106 serve to guide blades 104 and 106 to be reciprocated back and forth along parallel, side by side paths. It will be appreciated that the points of the pairs of respective projections 110' and 108' will act as gripping surfaces to pinch without piercing substantially the same as in the first embodiment, moving along linear instead of circular paths.

This linear, slidable reciprocation is powered, as seen in FIG. 10, by a conventional air cylinder 130 with a shaft 132 which is joined to a strut 134. Strut 134 rests in a slot 138 through base 114 and is bolted at 140 to slide 124. As shaft 132 extends, it will move all of the projections 108 and respective projections 110 together, and as it retracts it will move them apart.

The slidable reciprocation may be controlled by, and a gripping and released position defined by, an adjusting means in cooperation with air cylinder 130. As seen in FIG. 10, this adjusting means includes a pair of disc shaped stops 142 and 144 threaded onto a shaft 146 mounted to an end wall 148 of frame 112. Stops 142 and 144 are each adjustably held on shaft 146 by set screws 150. As shaft 132 of air cylinder 130 extends and retracts, strut 134 will alternately contact stops 142 and 144. FIG. 10 shows engagement with stop 144, which controls $D_r$. As shaft 132 is extended, strut 134 will engage stop 142 to define a gripping position, similarly to the previous embodiment. The distance strut 134 would travel is denoted $D_s$. $D_s$ would be set at $D_r$ minus whatever $D_g$ was desired for each material. The considerations for setting $D_g$ are exactly the same as for the first embodiment, and it is not separately illustrated. The surface of the material is gripped and released in exactly the same fashion. The entire mechanism 102 would be moved between a pick-up position and a remote position by any suitable means, such as the press 10 discussed in the previous embodiment.

It will be understood that other shapes of the projections on the support members would be possible. The point of the projection is merely to provide a gripping surface capable of a very precise, closely spaced gripping position. This allows a very small part of the top surface of the sheet material to be gripped. Such precision might be unnecessary with coarser materials. Other means of powering, guiding and adjustably controlling the support members to achieve the desired gripping and release positions may be conceived, and the invention is not intended to be limited to those two embodiments disclosed.

The embodiments of the invention in which an exclusive property or privilege is claimed are defined as follows:

1. An improved material pick-up mechanism of the type which is moved between a pick-up position against a sheet of fibrous material and a remote position for releasing it, said improved mechanism being adapted to pick up materials of varying texture and resiliency by pinching said materials without piercing and substantially without puckering the material, comprising, at least two support members each having at least two projections having a gripping surface thereon, the spacing between adjacent gripping surfaces on one support member being substantially identical to the other support member with all gripping surfaces being disposable substantially in a plane, means guiding the support members to be reciprocated relative to each other along substantially side by side paths such that each gripping surface of one support member moves together and apart within the plane relative to a respective gripping surface on the other support member as the support members are reciprocated, the substantially identical spacing between adjacent gripping surfaces on each support member serving to maintain a substantially identical spacing between the pairs of respective gripping surfaces, as they move together and apart, power means to reciprocate the support members so as to move the respective gripper surfaces together as the mechanism is moved to pick-up position against the material and apart when the mechanism is moved to the remote position, and adjusting means cooperable between the power means and the guiding means to control the reciprocation of the support members in accordance with the varying material texture and resiliency so that the respective gripping surfaces move a sufficient distance together, as they move against the material, without moving past one another, to a gripping position where said gripping surfaces are separated by a distance sufficiently small to pinch just sufficient fibers of the top surface of the material so that the material may be picked up without piercing the material and substantially without puckering the material, said gripping surfaces moving apart sufficiently to release the material when the mechanism is moved to the remote position, whereby materials of varying texture and resiliency may be picked up and released without damage.

2. An improved material pick-up mechanism of the type which is moved between a pick-up position against a sheet of fibrous material and a remote position for releasing it, said improved mechanism being adapted to pick up materials of varying texture and resiliency by pinching said materials without piercing and substantially without puckering the material, comprising, a pair of coaxial cylindrical support members closely received one within the other, each having a series of projections thereon, each projection having a gripping surface, the gripping surfaces on one support member being radially alignable in respective pairs with the gripping surfaces of the other support member, with all gripping surfaces being disposable substantially in a plane, means guiding the support members to be rotatably reciprocated one within the other along substantially side by side paths so that the two gripping surfaces of each respective pair of gripping surfaces move together and apart within the plane, the radial alignability of the respective pairs of gripping surfaces serving to maintain a substantially identical spacing therebetween as they move together and apart, power means to rotatably reciprocate the support members so as to move the respective gripper surfaces together as the mechanism is moved to pick-up position against the material and apart when the mechanism is moved to the remote position, and adjusting means cooperable between the power means and the guiding means to control the rotatable reciprocation of the support members in accordance with the varying material texture and resiliency so that the respective pairs of gripping surfaces move a sufficient distance together as they move against the material, without moving past one another, to a gripping position where said gripping surfaces are separated by a distance sufficiently small to pinch just sufficient fibers of the top surface of the material so that the material may be picked up without piercing the material and substantially without puckering the material, said gripping surfaces moving apart sufficiently to release the material when the mechanism is moved to the remote position, whereby materials of varying texture and resiliency may be picked up and released without damage.

3. An improved material pick-up mechanism of the type which is moved between a pick-up position against a sheet of fibrous material and a remote position for releasing it, said improved mechanism being adapted to pick up materials of varying texture and resiliency by pinching said materials without piercing and substantially without puckering the material, comprising, at least two linear support members each having a series of projections thereon, each projection having a gripping surface thereon, the spacing between adjacent gripping surfaces on each support member being substantially identical with all gripping surfaces being disposable substantially in a plane, means guiding the support members to be reciprocated relative to each other along substantially side by side paths such that each gripping surface of one support member moves together and apart within the plane relative to a respective gripping surface on the other support member as the support members are reciprocated, the substantially identical spacing between adjacent gripping surfaces on each support member serving to maintain a substantially identical spacing between the pairs of respective gripping surfaces as they move together and apart, power means to reciprocate the support members so as to move the respective gripper surfaces together as the mechanism is moved to pick-up position against the material and apart when the mechanism is moved to the remote position, and adjusting means cooperable between the power means and the guiding means to control the reciprocation of the support members in accordance with the varying material texture and resiliency so that the respective gripping surfaces move a sufficient distance together as they move against the material, without moving past one another, to a gripping position where said gripping surfaces are separated by a distance sufficiently small to pinch just sufficient fibers of the top surface of the material so that the material may be picked up without piercing the material and substantially without puckering the material, said gripping surfaces moving apart sufficiently to release the material when the mechanism is moved to the remote position, whereby materials of varying texture and resiliency may be picked up and released without damage.

* * * * *